US009658561B2

(12) United States Patent
Hasegawa

(10) Patent No.: US 9,658,561 B2
(45) Date of Patent: May 23, 2017

(54) IMAGE FORMING DEVICE AND METHOD FOR CORRECTING SCANNING POSITION OF LUMINOUS FLUX

(71) Applicant: KONICA MINOLTA, INC., Chiyoda-ku, Tokyo (JP)

(72) Inventor: Ryo Hasegawa, Hachioji (JP)

(73) Assignee: KONICA MINOLTA, INC., Chiyoda-ku, Tokyo (JP)

( * ) Notice: Subject to any disclaimer, the term of this patent is extended or adjusted under 35 U.S.C. 154(b) by 17 days.

(21) Appl. No.: 14/972,719

(22) Filed: Dec. 17, 2015

(65) Prior Publication Data

US 2016/0187805 A1 Jun. 30, 2016

(30) Foreign Application Priority Data

Dec. 25, 2014 (JP) ..... 2014-262389

(51) Int. Cl.
*B41J 27/00* (2006.01)
*G03G 15/043* (2006.01)

(52) U.S. Cl.
CPC ..... *G03G 15/043* (2013.01)

(58) Field of Classification Search
CPC ..... G03G 15/043; B41J 27/00
USPC ..... 399/4; 347/116, 261
See application file for complete search history.

(56) References Cited

U.S. PATENT DOCUMENTS 5,933,184 A 8/1999 Ishigami et al.
2003/0025785 A1 2/2003 Nihei et al.
2003/0067533 A1 4/2003 Omori et al.
(Continued)

FOREIGN PATENT DOCUMENTS

JP H09-174917 A 7/1997
JP 2000-103115 A 4/2000
(Continued)

OTHER PUBLICATIONS

Office Action (Notice of Reasons for Rejection) issued on Jan. 31, 2017, by the Japanese Patent Office in corresponding Japanese Patent Application No. 2014-262389 and an English Translation of the Office Action. (12 pages).

*Primary Examiner* — Clayton E Laballe
*Assistant Examiner* — Fang-Chi Chang
(74) *Attorney, Agent, or Firm* — Buchanan Ingersoll & Rooney PC

(57) ABSTRACT

An image forming device scans and exposes a photoreceptor with a luminous flux by a light scanning device, which includes a polygon mirror that deflects the luminous flux and scans the photoreceptor in a main scanning direction, a correction unit that corrects a scanning position of the luminous flux in the main scanning direction such that the scanning position of the luminous flux coincides with each reference position, and a position deviation detection unit that detects the deviation amount of the scanning position of the luminous flux in a sub scanning direction. The correction unit corrects the scanning position of the luminous flux in the main scanning direction such that a screen line with an aimed screen angle is formed by scanning with the luminous flux whose scanning position in the sub scanning direction has deviated by the deviation amount detected by the position deviation detection unit.

5 Claims, 10 Drawing Sheets

(56) References Cited

U.S. PATENT DOCUMENTS

| | | | | |
|---|---|---|---|---|
| 2004/0057096 | A1* | 3/2004 | Amada | B41J 2/473 359/204.1 |
| 2004/0125199 | A1* | 7/2004 | Omori | G03G 15/305 347/249 |
| 2010/0045766 | A1 | 2/2010 | Imai et al. | |
| 2012/0086985 | A1* | 4/2012 | Iioka | H04N 1/52 358/3.06 |

FOREIGN PATENT DOCUMENTS

| | | | |
|---|---|---|---|
| JP | 2003-98465 | A | 4/2003 |
| JP | 2003-103830 | A | 4/2003 |
| JP | 2005-96086 | A | 4/2005 |
| JP | 2005-231090 | A | 9/2005 |
| JP | 2011-16312 | A | 1/2011 |
| JP | 2011-197320 | A | 10/2011 |

* cited by examiner

IMAGE FORMING DEVICE AND METHOD FOR CORRECTING SCANNING POSITION OF LUMINOUS FLUX

The entire disclosure of Japanese Patent Application No. 2014-262389 filed on Dec. 25, 2014 including description, claims, drawings, and abstract are incorporated herein by reference in its entirety.

BACKGROUND OF THE INVENTION

Field of the Invention

The present invention relates to an image forming device and a method for correcting a scanning position of a luminous flux.

Description of the Related Art

An electrophotographic image forming device generally forms a latent image of an image on one page by deflecting a laser beam, which has been modulated based on original image data, by a polygon mirror and repeatedly scanning on a rotating photoreceptor in a main scanning direction. An image can be formed on paper by transferring, on the paper via an image carrier such as an intermediate transfer belt, an image which has been developed by feeding a color material such as toner on the photoreceptor, on which the latent image has been formed.

In a case where an image is formed by superimposing images of a plurality of colors, in order to adjust a position of the image of each color, timing for initiating scanning by the polygon mirror in the main scanning direction is synchronized with timing for initiating scanning by rotation of the photoreceptor in a sub scanning direction (for example, see JP 2000-103115 A).

However, even when a first scanning position is synchronized, a scanning position of a luminous flux in a main scanning direction may change due to unevenness, for example, of mirror surfaces of a polygon mirror and cause deviation of an image position within one scanning line. The scanning position in a sub scanning direction may also deviate depending on characteristics of the mirror.

Such a deviation of the scanning position, attributable to the polygon mirror, may be repeated with a rotational period of the polygon mirror and observed as a density fluctuation.

In particular, like a screen pattern, for example, where dots are arranged regularly, an image having a periodic pattern is likely to generate the density fluctuation called moire by a periodic deviation of a scanning position.

SUMMARY OF THE INVENTION

An object of the present invention is to reduce the density fluctuation caused by the deviation of a scanning position of a luminous flux.

To achieve the abovementioned object, according to an aspect, there is provided an image forming device, reflecting one aspect of the present invention, for scanning and exposing a photoreceptor with a luminous flux by a light scanning device, wherein the light scanning device comprises: a polygon mirror that deflects the luminous flux that has been emitted from a light source and scans the photoreceptor in a main scanning direction; a correction unit that corrects a scanning position of the luminous flux in the main scanning direction such that the scanning position of the luminous flux coincides with each reference position in accordance with a pre-detected deviation amount of the scanning position of the luminous flux in the main scanning direction from each reference position in the main scanning direction; and a position deviation detection unit that detects the deviation amount of the scanning position of the luminous flux in a sub scanning direction from the reference position in the sub scanning direction, and the correction unit corrects the scanning position of the luminous flux in the main scanning direction, in a case where a screen line is formed by scanning with the luminous flux, such that a screen line with an aimed screen angle is formed by scanning with the luminous flux whose scanning position in the sub scanning direction has deviated by the deviation amount that has been detected by the position deviation detection unit.

According to an invention of Item. 2, there is provided the image forming device according to Item. 1, wherein the position deviation detection unit preferably detects the deviation amount of the scanning position of the luminous flux in the sub scanning direction, using a sensor which detects a luminous flux used to scan near a starting end of each scanning line and generates a horizontal synchronizing signal.

According to an invention of Item. 3, there is provided the image forming device according to Item. 1 or 2, wherein the light scanning device preferably emits a plurality of luminous fluxes in parallel by the light source, scans with the luminous fluxes in parallel by the polygon mirror, and corrects the scanning positions of the luminous fluxes in the main scanning direction by the correction unit.

According to an invention of Item. 4, there is provided the image forming device according to any one of Items. 1 to 3, preferably including a plurality of the light scanning devices corresponding to respective colors, arranged in series, wherein the light scanning devices correct, by respective correction units, the scanning position of the luminous flux in the main scanning direction such that a screen line with a screen angle corresponding to each color is formed.

To achieve the abovementioned object, according to an aspect, a method for correcting a scanning position of a luminous flux used for scanning in a main scanning direction by deflecting a luminous flux that has been emitted from a light source by a polygon mirror, reflecting one aspect of the present invention comprises: (a) a step of correcting the scanning position of the luminous flux in the main scanning direction in accordance with a pre-detected deviation amount of the scanning position of the luminous flux in the main scanning direction from each reference position in the main scanning direction, such that the scanning position of the luminous flux coincides with each reference position; (b) a step of detecting the deviation amount of the scanning position of the luminous flux in a sub scanning direction from the reference position in the sub scanning direction; and (c) a step of correcting the scanning position of the luminous flux in the main scanning direction such that a screen line with an aimed screen angle is formed by scanning with the luminous flux whose scanning position in the sub scanning direction has deviated by the deviation amount that has been detected in the step (b).

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an image forming device and a method for correcting a scanning position of a luminous flux according to an embodiment of the present invention will be described with reference to the drawings. However, the scope of the invention is not limited to the illustrated examples.

Figure 1:
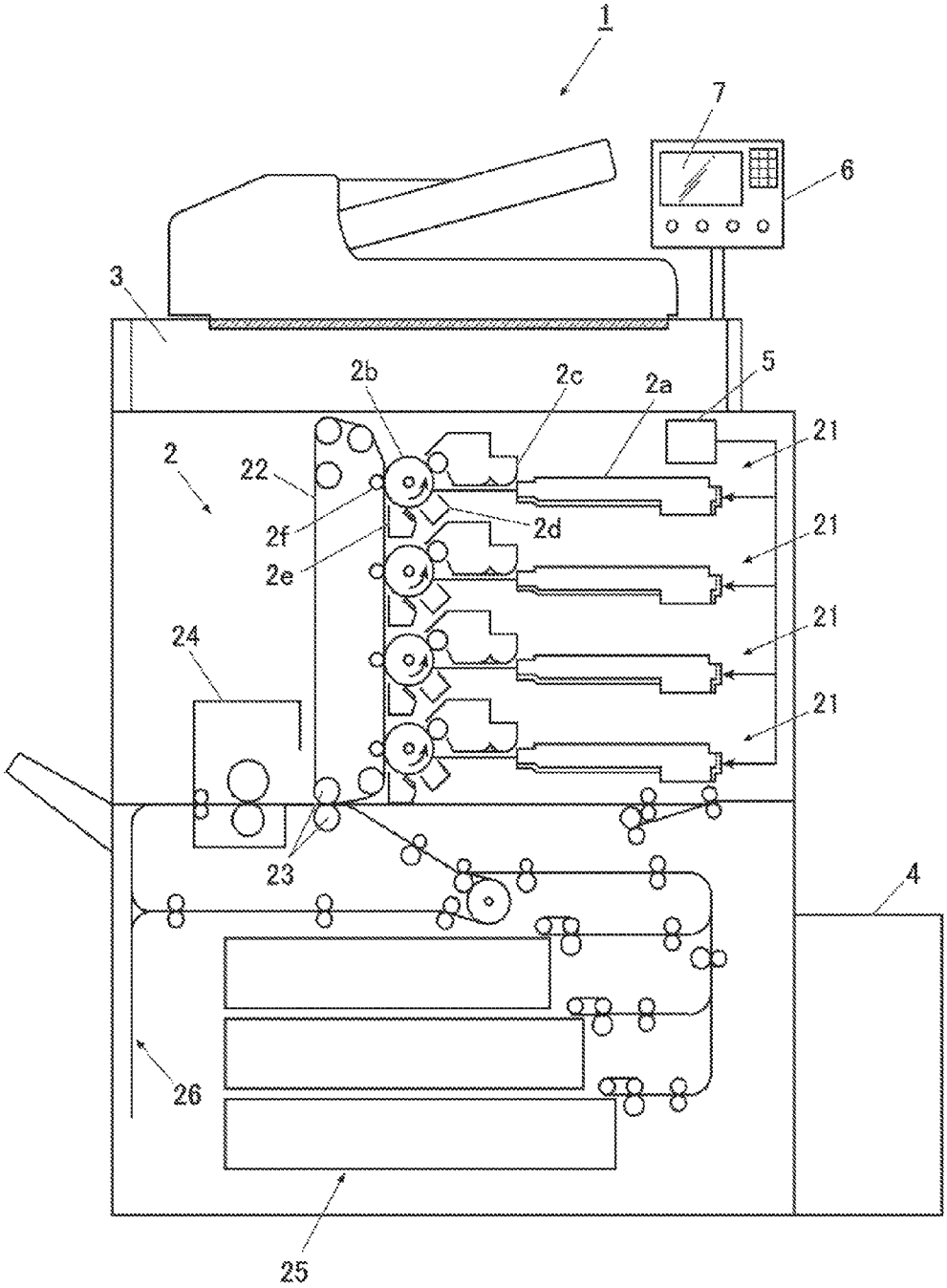
FIG. 1 is a front view illustrating an outline of an image forming device according to the present embodiment.

FIG. 1 illustrates a schematic configuration of an image forming device 1 of the present embodiment.

The image forming device 1 includes, as illustrated in FIG. 1, an image forming unit 2, which forms an image on paper based on original image data in bit map format.

The image forming device 1 also includes an image reading unit 3, an image generating unit 4, an image processing unit 5, an operating unit 6, and a display unit 7. The image reading unit 3 reads an original image and generates original image data. The image generating unit 4 generates original image data in response to an image formation instruction from outside. The image processing unit 5 subjects the generated original image data to image processing. The operating unit 6 and the display unit 7 each serve as a user interface.

The image forming unit 2 forms an image of a plurality of colors on paper based on the original image data that have been subjected to the image processing by the image processing unit 5.

The image forming unit 2 includes, as illustrated in FIG. 1, four writing units 21, an intermediate transfer belt 22, secondary transfer rollers 23, a fixing device 24, paper feed trays 25, and an inversion route 26.

The writing units 21 are arranged in series (tandem) along a belt surface of the intermediate transfer belt 22. The intermediate transfer belt 22 is an image carrier which is wound by a plurality of rollers and rotates. The rollers include primary transfer rollers 2*f* and secondary transfer rollers 23. The secondary transfer rollers 23 and the fixing device 24 are arranged on a conveyance route of paper to be conveyed from the paper feed trays 25.

Each of the four writing units 21 forms a C (cyan), M (magenta), Y (yellow), or K (black) image. The writing units 21 have the same configuration, and each include, as illustrated in FIG. 1, a light scanning device 2*a*, a photoreceptor 2*b*, a developing unit 2*c*, a charging unit 2*d*, a cleaning unit 2*e*, and the primary transfer roller 2*f*.

At the time of forming an image, in each writing unit 21, an electrostatic latent image is formed by scanning the photoreceptor 2*b* with a luminous flux that has been emitted by the light scanning device 2*a* based on the original image data, after a voltage is applied to and charged at the photoreceptor 2*b* by the charging unit 2*d*. When a color material such as toner is fed by the developing unit 2*c* and the electrostatic latent image on the photoreceptor 2*b* is developed, an image is formed on the photoreceptor 2*b*.

When formed on the photoreceptor 2*b* of each writing unit 21, the image of each color is sequentially superimposed and transferred (primary transfer) on the intermediate transfer belt 22 by its own primary transfer roller 2*f*, and an image of a plurality of colors is formed. After the primary transfer, in each writing unit 21, the color material remaining on the photoreceptor 2*b* is removed by the cleaning unit 2*e*.

Next, paper is fed by the paper feed tray 25 and the image on the intermediate transfer belt 22 is transferred on the paper by the secondary transfer rollers 23. The paper after the transfer is heated and pressurized by the fixing device 24, and the image is fixed on the paper.

In a case where an image is formed on both sides of a piece of paper, the paper is conveyed to the inversion route 26 and the surface of the paper is inversed, and then again the paper is conveyed to the secondary transfer rollers 23.

The image reading unit 3 reads an original image that has been set by a user, and generates original image data in bit map format for each color of R (red), G (green), and B (blue).

The image generating unit 4 receives data with instruction items for generating images described in a page description language (PDL) from an external device such as a user terminal and a server over a network, and generates, by rasterizing the data, original image data in bit map format for each color of C, M, Y, and K.

The image processing unit 5 converts the color of the original image data for each color of R, G, and B, having been generated by the image reading unit 3, and outputs original image data for each color of C, M, Y, and K.

The image processing unit 5 also subjects the original image data after color conversion or the original image data that have been generated by the image generating unit 4 to image processing such as gradation correction and halftone processing. The gradation correction is processing for converting a gradation value of each pixel of the original image data into a gradation value which has been corrected such that a density of an image that has been formed on paper matches a target density. Halftone processing includes, for example, error diffusion processing and screen processing using a systematic dither method.

Figure 2:
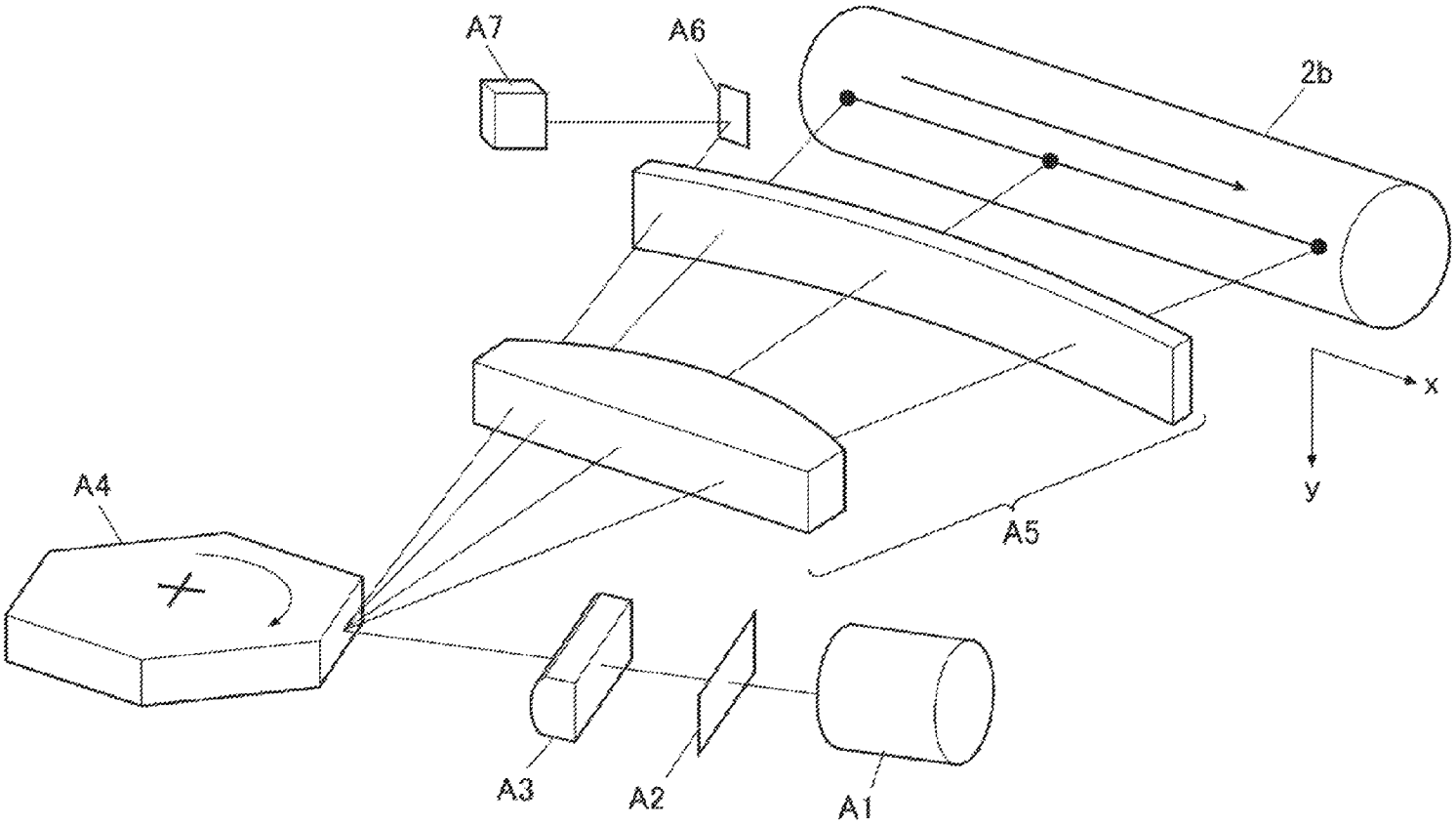
FIG. 2 is a perspective view illustrating an outline of a light scanning device of FIG. 1.

FIG. 2 illustrates a schematic configuration of the light scanning device 2*a*.

As illustrated in FIG. 2, a light source A1 and a polygon mirror A4 are arranged in the light scanning device 2*a*. The light source A1 emits a luminous flux by laser emission. The polygon mirror A4 includes a plurality of mirrors around a rotating shaft, and deflects, by reflecting the luminous flux that has been emitted from the light source A1 on each mirror surface which rotates around the rotating shaft, the luminous flux so as to scan the photoreceptor 2*b* in a main scanning direction x. FIG. 2 illustrates an example of the polygon mirror A4, in which six mirrors are arranged to form sides of a regular hexagon, but the number of mirrors is not limited to six.

Between the light source A1 and the polygon mirror A4, a collimator lens A2 and a cylindrical lens A3 are arranged. The collimator lens A2 converts a luminous flux into parallel light. The cylindrical lens A3 converges parallel light on the photoreceptor 2*b* in a sub scanning direction y which is perpendicular to the main scanning direction x, and forms an image on the mirror surface of the polygon mirror A4.

Between the polygon mirror A4 and the photoreceptor 2*b*, a group of lenses A5 is arranged. The lenses A5 include an fθ lens, a cylindrical lens, and the like. The fθ lens corrects aberration of a luminous flux such that the luminous flux, which has been deflected by the polygon mirror A4, scans the photoreceptor 2*b* at a constant speed. The cylindrical lens has power (refractive power) in the sub scanning direction y, and images the luminous flux on the photoreceptor 2*b*.

Near the starting end in the main scanning direction x, a sensor A7 and a mirror A6 are arranged. The sensor A7 detects a luminous flux which scans the starting end side rather than an image area of each scanning line and generates a horizontal synchronizing signal. The mirror A6 leads a luminous flux to the sensor A7. The horizontal synchronizing signal is a synchronizing signal indicating a timing for initiating scanning of each scanning line in the main scanning direction x.

When a mirror, which reflects and deflects a luminous flux from the light source A1 by the rotation of the polygon mirror A4, switches to an adjacent mirror, the scanning position of the luminous flux returns to the starting end. Therefore, by rotating the photoreceptor 2*b* and moving the scanning position in the sub scanning direction y, an electrostatic latent image of each scanning line can be formed on the photoreceptor 2*b*.

Figure 3:
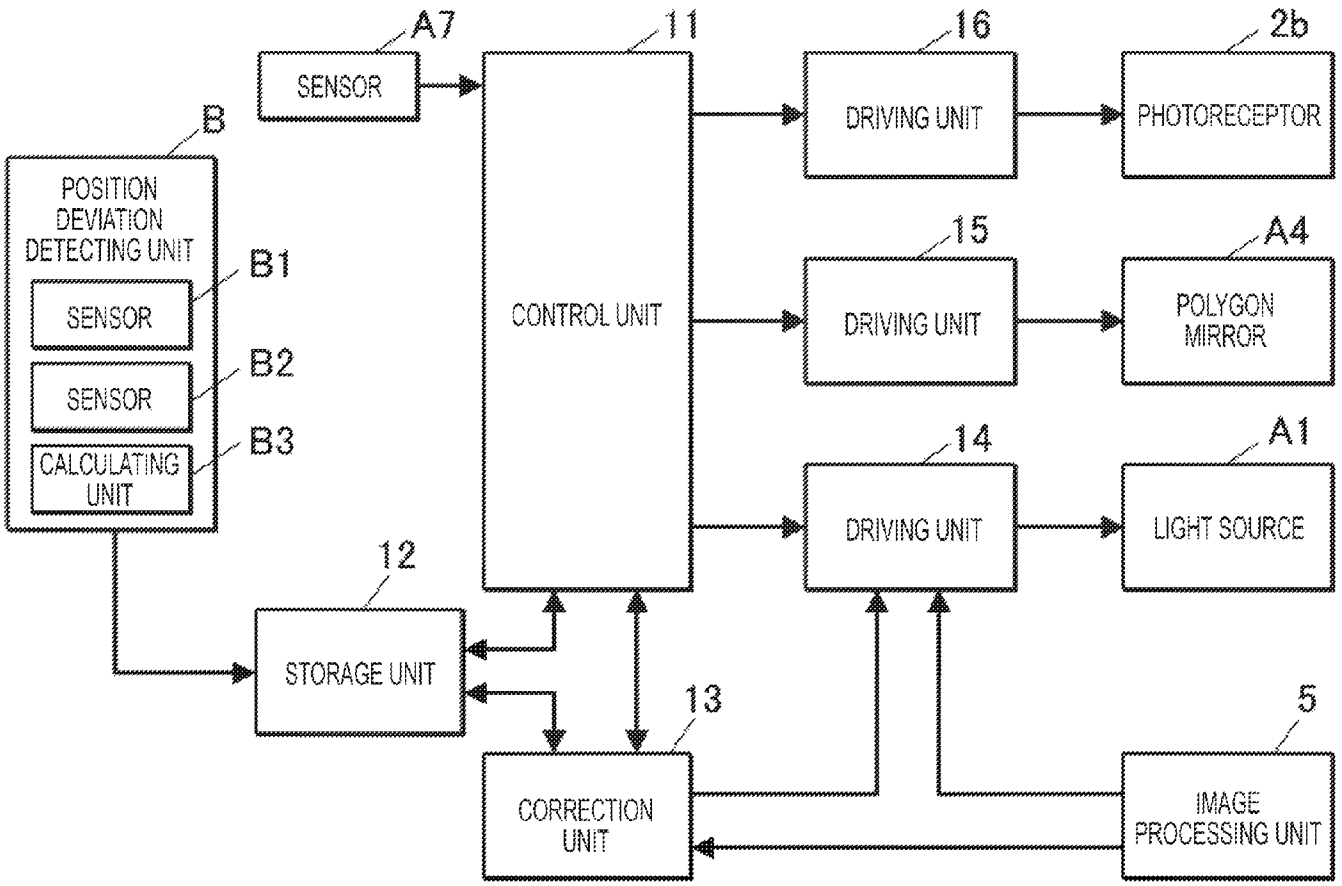
FIG. 3 is a block diagram illustrating a configuration of a control system of the light scanning device for each function.

FIG. 3 is a block diagram illustrating the control system of the light scanning device 2*a* for each function.

As illustrated in FIG. 3, the light scanning device 2*a* includes a control unit 11, a storage unit 12, a correction unit 13, a driving unit 14 of the light source A1, a driving unit 15 of the polygon mirror A4, a driving unit 16 of the photoreceptor 2*b*, and a position deviation detection unit B.

The control unit 11 controls light emission driving of the light source A1, and rotation driving of the polygon mirror A4 and the photoreceptor 2*b*, and synchronizes positions for initiating scanning of each scanning line in the main scanning direction x and in the sub scanning direction y.

For example, the control unit 11 outputs the horizontal synchronizing signal that has been generated by the sensor A7 to the driving unit 14, and controls a light emission operation of the light source A1.

The control unit 11 also outputs a clock signal for rotation driving to the driving units 15 and 16, and controls rotation speeds of the polygon mirror A4 and the photoreceptor 2*b*.

The control unit 11 can include a central processing unit (CPU), a random access memory (RAM), and the like, and controls the above by executing a program that has been read from the storage unit 12.

The storage unit 12 stores, for example, a program to be read by the control unit 11.

The storage unit 12 stores deviation amounts of a scanning position of the luminous flux scanned by the polygon mirror A4 from each reference position in the main scanning direction x and in the sub scanning direction y. The deviation amount of the scanning position in the main scanning direction x is a deviation amount that has been detected in advance by a dedicated position deviation detection unit at the time of, for example, manufacturing the image forming device 1. The deviation amount of the scanning position in the sub scanning direction y is a deviation amount that has been detected by the position deviation detection unit B. The deviation amount is different from mirror to mirror of the polygon mirror A4. Therefore, the storage unit 12 stores the deviation amount of each mirror in association with the number of each mirror.

The correction unit 13 corrects the scanning position of the luminous flux used for scanning by the polygon mirror A4 in the main scanning direction x, in accordance with the pre-detected deviation amount, which has been stored in the storage unit 12, of the scanning position from each reference position in the main scanning direction x, such that the scanning position of the luminous flux in the main scanning direction x coincides with each reference position in the main scanning direction x.

The correction unit 13 can correct the scanning position in the main scanning direction x to an arbitrary position by generating a clock signal to be output to the driving unit 14 in accordance with the deviation amount.

In a case where a deviation of the scanning position of the luminous flux occurs in the sub scanning direction y, the correction unit 13 corrects the scanning position of the luminous flux used for scanning by the polygon mirror A4 in the main scanning direction x, such that a screen line with an aimed screen angle is formed even by the luminous flux, the scanning position of which has deviated.

In this case, the correction unit 13 can correct the scanning position of the luminous flux in the main scanning direction x for each scanning line, by outputting a signal for correcting the horizontal synchronizing signal to the control unit 11 and either delaying or advancing the timing for initiating scanning, indicated by the horizontal synchronizing signal.

The driving unit 14 of the light source A1 modulates a pulse width of the original image data that have been output from the image processing unit 5 in synchronization with the clock signal to be output from the correction unit 13 and generates a driving signal. The driving unit 14 pulse-drives the light source A1 and emits a luminous flux by outputting the generated driving signal to the light source A1.

The driving unit 15 of the polygon mirror A4 rotatively drives the polygon mirror A4 at a predetermined rotation speed by controlling a driving voltage thereof based on the clock signal, which has been output from the control unit 11, for rotatively driving the polygon mirror A4.

Similarly, the driving unit 16 of the photoreceptor 2*b* rotatively drives the photoreceptor 2*b* at a predetermined rotation speed based on the clock signal, which has been output from the control unit 11, for rotatively driving the photoreceptor 2*b*.

The position deviation detection unit B detects the deviation amount of the scanning position of the luminous flux used for scanning by the polygon mirror A4 in the sub scanning direction y.

The position deviation detection unit B includes, as illustrated in FIG. 3, two sensors B1 and B2 and a calculating unit B3.

The sensors B1 and B2 are arranged on the scanning line of the luminous flux outside the image area, led by the mirror A6 as with the sensor A7. In order to curtail costs, the sensor A7 that generates the horizontal synchronizing signal can be used as the sensor B1. The calculating unit B3 calculates the deviation amount of the scanning position in the sub scanning direction y based on detection signals from sensors B1 and B2.

Figure 4:
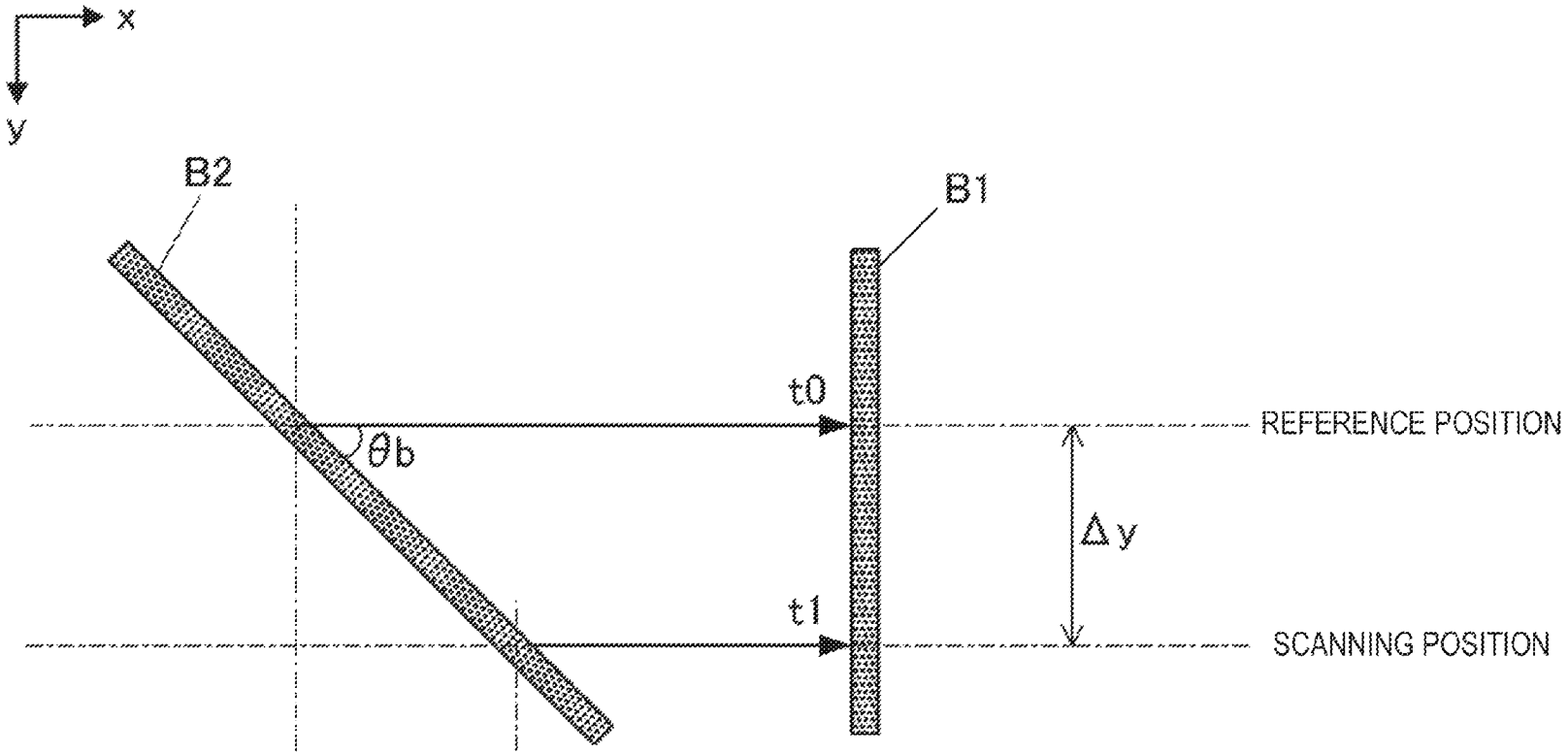
FIG. 4 is a front view illustrating two sensors used for detecting a deviation of a scanning position in a sub scanning direction.

FIG. 4 illustrates a layout of the sensors B1 and B2.

As illustrated in FIG. 4, the sensor B1 is a line sensor arranged in parallel with the sub scanning direction y, while the sensor B2 is a line sensor arranged to incline by an angle θb with respect to the sub scanning direction y.

[Correction of Deviation in Main Scanning Direction x]

A deviation amount of the scanning position of the light scanning device 2*a* in the main scanning direction x is detected in advance at the time of, for example, manufacturing the image forming device 1, and stored in the storage unit 12.

Figure 5:
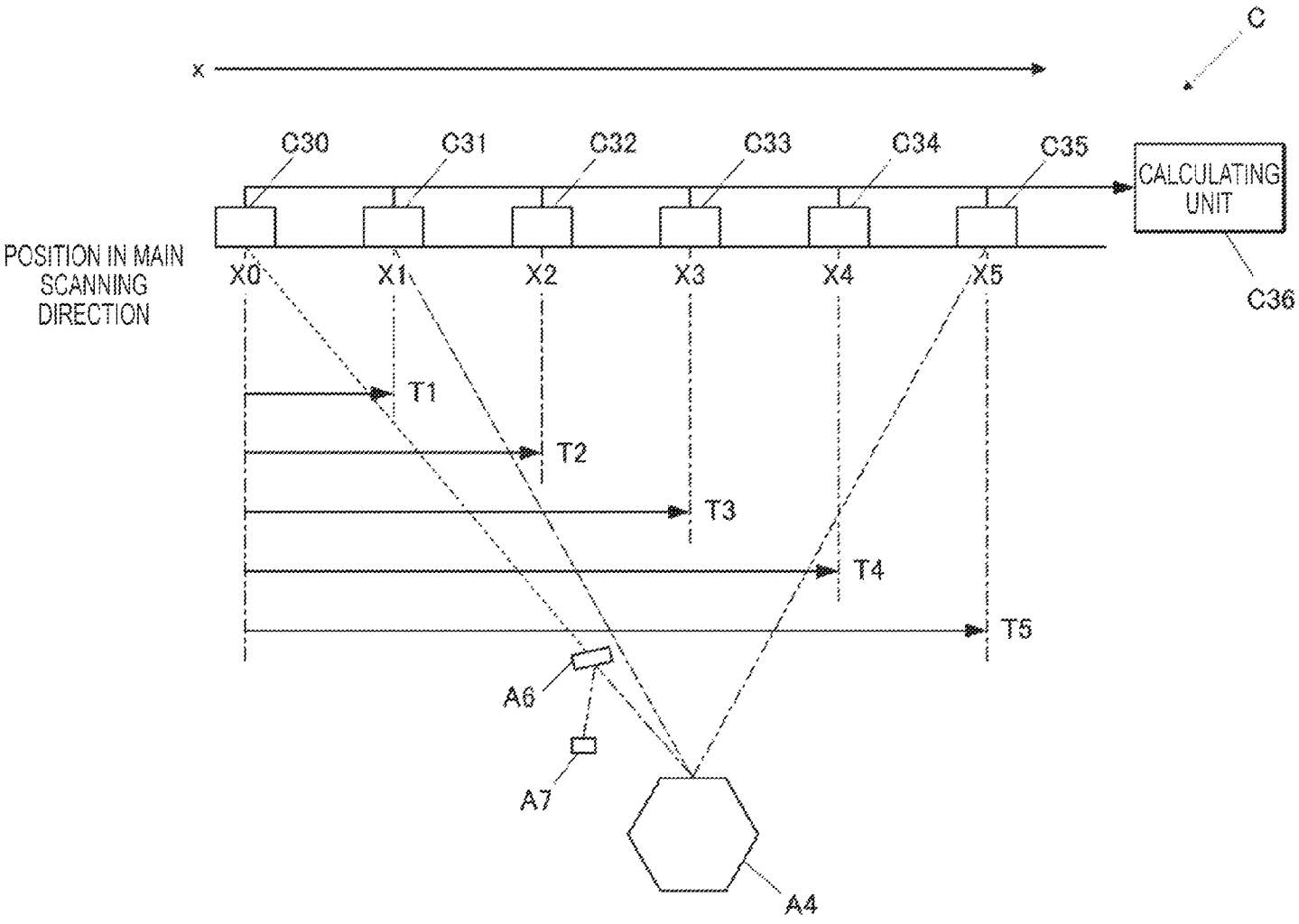
FIG. 5 is a diagram illustrating an outline of a position deviation detection unit used for detecting a deviation of a scanning position in a main scanning direction.

FIG. 5 illustrates the position deviation detection unit C used for detecting the deviation of the scanning position in the main scanning direction x. In detecting the deviation, the position deviation detection unit C is arranged at the same position as the photoreceptor 2*b*.

As illustrated in FIG. 5, the position deviation detection unit C includes a plurality of sensors C30 to C35 and a calculating unit C36. The sensors C30 to C35 are arranged at six reference positions X0 to X5 in the main scanning direction x, respectively. The calculating unit C36 calculates the deviation amount based on detection signals from each of the sensors C30 to C35.

The reference positions X0 to X5 may be at equal intervals or at arbitrary positions from a starting end to a terminal end of the scanning line in the main scanning direction x. As the sensor C30 to be arranged at the reference position X0 on the starting end side of the scanning line, the sensor A7 that generates the horizontal synchronizing signal may be used. In a case where more reference positions than sensors are set, it is possible to move the sensors C30 to C35 at a constant speed in the main scanning direction x in accordance with the luminous flux and detect the luminous flux at each reference position.

In detecting the position deviation, each of the sensors C30 to C35 detects the luminous flux used for scanning by the polygon mirror A4 in the main scanning direction x. The calculating unit C36 analyzes the detection signals that have been output from each of the sensors C30 to C35, and derives scanning times T1 to T5 from the time when the luminous flux is detected by the sensor C30 to the time when the luminous flux is detected by each of the sensors C31 to C35. The calculating unit C36 calculates actual scanning positions X1* to X5* of the luminous flux from these scanning times T1 to T5, the distance from the reference position X0 to each of the reference positions X1 to X5, and a scanning speed V of the luminous flux. The calculating unit C36 calculates differences X1−X1* to X5−X5* between each of the reference positions X1 to X5 and each of the scanning positions X1* to X5* as the deviation amount of the scanning position from each reference position in the main scanning direction x.

The deviation of the scanning position is caused by, for example, unevenness of a mirror surface of the polygon mirror A4, and the deviation amount specific to each mirror is caused. Therefore, the above-mentioned deviation of the scanning position is detected for each mirror by the position deviation detection unit C, and the detected deviation amount is stored in the storage unit 12 while being associated with the number of each mirror.

Figure 6:
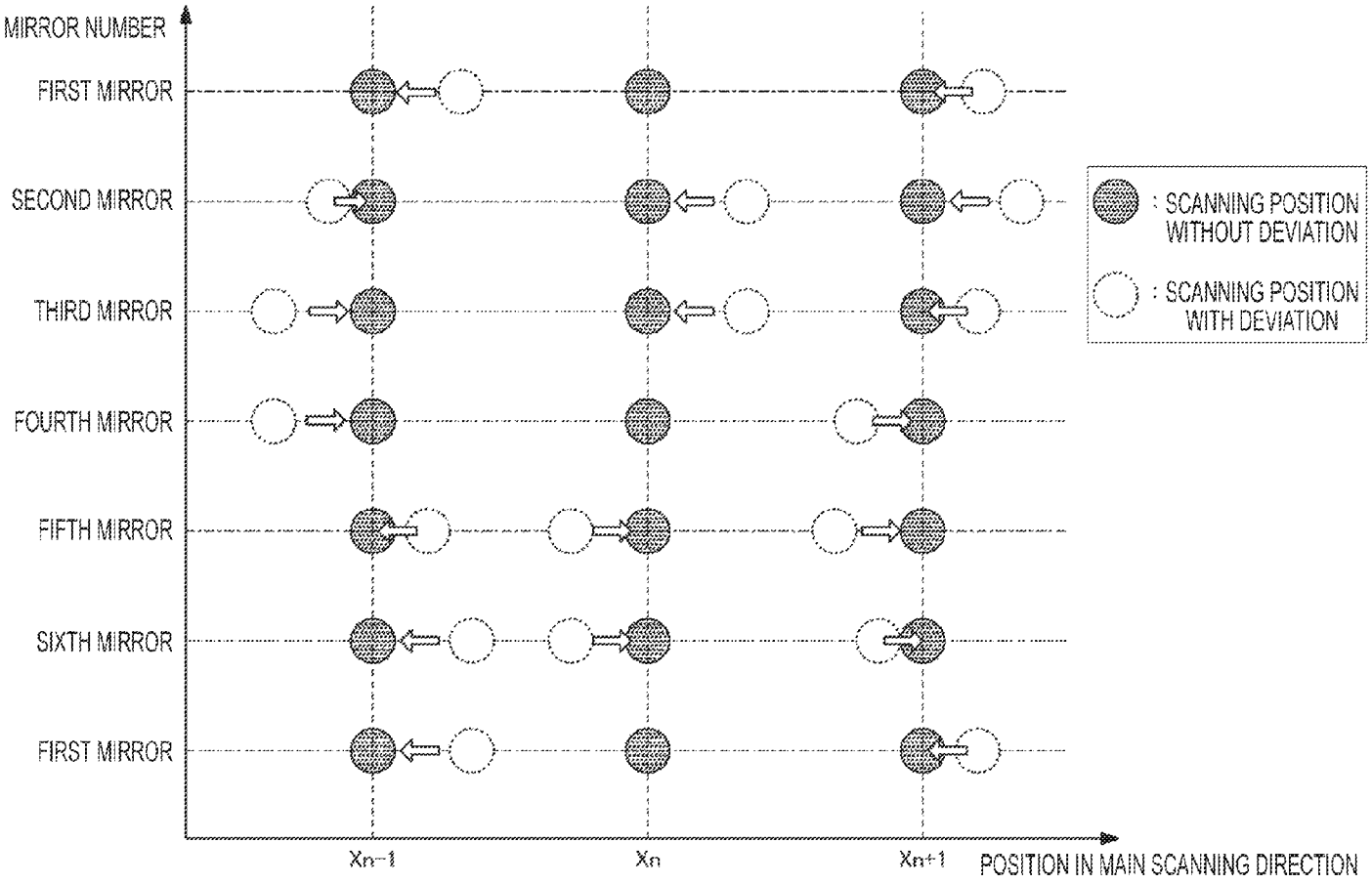
FIG. 6 is a diagram illustrating deviations of a scanning position from each reference position in the main scanning direction.

FIG. 6 illustrates the scanning positions of the luminous flux with and without deviations at reference positions Xn−1, Xn, and Xn+1 for each mirror from the first to sixth mirrors.

As illustrated in FIG. 6, a direction of the deviation of the scanning position from the reference position differs for each mirror from the first to sixth mirrors, whereas the direction of the deviation of the first mirror is the same at the first and second rotations. Even within one scanning line, the deviation amount of the scanning position is different depending on the reference position. In order to correct the scanning position to coincide with each reference position, it is necessary to make a correction in accordance with each deviation amount.

In scanning with the luminous flux, the correction unit 13 obtains from the control unit 11 the number of the next mirror of the polygon mirror A4, assumed to scan with the luminous flux, and obtains from the storage unit 12 the deviation amount of the scanning position, corresponding to the number of the mirror, from each reference position in the main scanning direction x. Next, the correction unit 13 generates a clock signal of a frequency in accordance with the obtained deviation amount.

For example, at the reference position Xn+1 of the first mirror illustrated in FIG. 6, the scanning position deviates toward a terminal end. When this deviation amount is represented as Δx1, a clock signal of a frequency, which is higher than a fundamental frequency in a case where there are no deviations of the scanning position, is generated at the reference positions Xn to Xn+1 so as to shorten the scanning distance between the reference positions Xn and Xn+1 by Δx1. On the other hand, at the reference position Xn+l of the fourth mirror, the scanning position deviates toward a starting end. When this deviation amount is represented as Δx2, a clock signal of a frequency which is lower than the fundamental frequency is generated at the reference positions Xn to Xn+1 so as to lengthen the scanning distance between the reference positions Xn and Xn+1 by Δx2.

Thus, by driving light emission of the light source A1 by the driving unit 14 based on the clock signal in accordance with the deviation amount from each reference position, the scanning position of the luminous flux by each mirror can, as indicated by arrows of FIG. 6, coincide with each of the reference positions Xn−1, Xn, and Xn+1.

[Correction of Deviation in Sub Scanning Direction y]

In a case where a deviation of the scanning position of the luminous flux occurs in the sub scanning direction y, when a screen line is formed by the luminous flux, the screen line partially deviates. Repetition of this deviation may be observed as the density fluctuation. In this case, the density fluctuation attributable to the deviation can be reduced by correcting the scanning position of the luminous flux in the main scanning direction x in accordance with the deviation amount of the scanning position in the sub scanning direction y.

First, the deviation amount in the sub scanning direction y is detected by the position deviation detection unit B. Specifically, as illustrated in FIG. 4, the sensors B1 and B2 detect the luminous flux used for scanning by the polygon mirror A4 in the main scanning direction x. The calculating unit B3 analyzes the detection signals that have been output from the sensors B1 and B2, and calculates a scanning time t1 from the time when the luminous flux is detected by the sensor B2 to the time when the luminous flux is detected by the sensor B1.

The calculating unit B3 calculates, as indicated in a formula below, the deviation amount of the scanning position Δy from the reference position in the sub scanning direction y based on scanning times t0 and t1, a scanning speed V of the luminous flux, and an inclination angle θb of the sensor B2. The scanning time t0 is, in a case where the luminous flux is at the reference position in the sub scanning direction y, the scanning time from the time when the luminous flux is detected by the sensor B2 to the time when the luminous flux is detected by the sensor B1. The scanning time t0 that has been measured in advance is set in the formula below.

$$\Delta y = V(t0 - t1) \times \tan \theta b$$

The deviation amount Δy in the sub scanning direction y also differs for each mirror of the polygon mirror A4. Therefore, the position deviation detection unit B detects the deviation amount of the scanning position Δy for each mirror, and stores the detected deviation amount Δy in the storage unit 12 in association with the number of each mirror.

In scanning with the luminous flux, the correction unit 13 obtains from the control unit 11 the number of the next mirror of the polygon mirror A4, assumed to scan with the luminous flux, and obtains from the storage unit 12 the deviation amount of the scanning position Δy in the sub scanning direction y, corresponding to the number of the mirror. The correction unit 13 also obtains, from the image processing unit 5, a screen angle θa of the screen line formed by the luminous flux.

Figure 7:
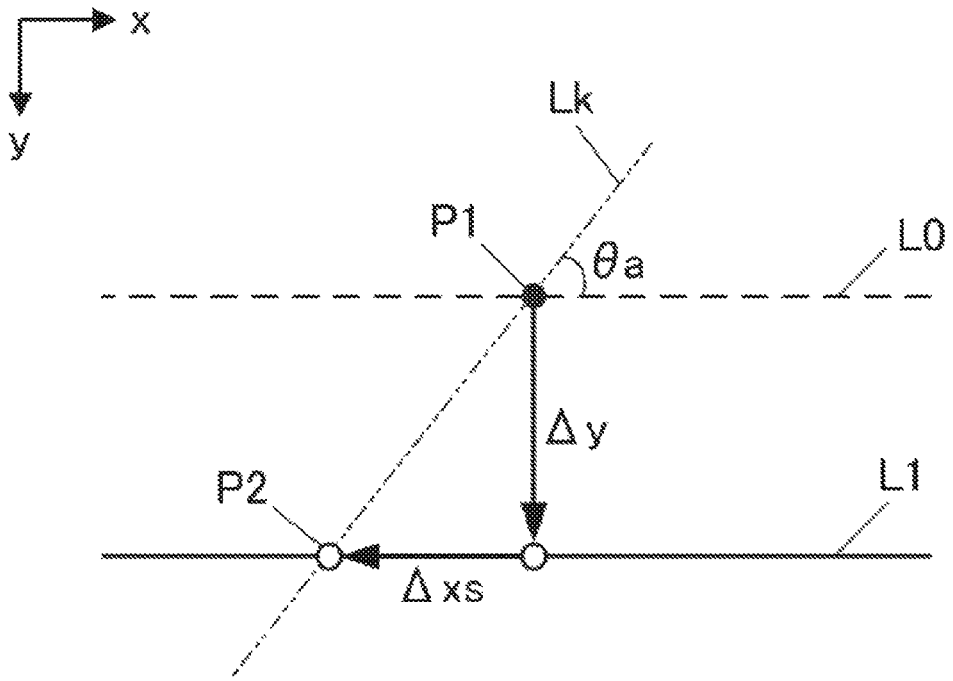
FIG. 7 is a diagram illustrating an amount of partial deviation of a screen line in the main scanning direction, caused by the deviation of a scanning position in the sub scanning direction.

As illustrated in FIG. 7, the correction unit 13 obtains x-y coordinates of an intersection P1 between a screen line Lk with the obtained screen angle θa and a scanning line L0 at a reference position in the sub scanning direction y. The correction unit 13 also obtains x-y coordinates of an intersection P2 between the screen line Lk and a scanning line L1 which deviates from the reference position by the obtained deviation amount Δy. As represented by the formula below, the correction unit 13 calculates, from the screen angle θa and the deviation amount Δy, a deviation amount Δxs of the intersections P1 and P2 in the main scanning direction x. This deviation amount Δxs is a deviation amount, in the main scanning direction x, of the screen line which partially deviates due to the deviation of the scanning position in the sub scanning direction y.

$$\Delta xs = \Delta y / \tan \theta a$$

The correction unit 13 generates and outputs to the control unit 11 a correction signal for delaying or advancing the horizontal synchronizing signal by the phase of Δxs. The control unit 11 corrects the horizontal synchronizing signal based on the correction signal output from the correction unit 13. The control unit 11 then outputs the horizontal synchronizing signal to the driving unit 14 after delaying or advancing, by the phase of Δxs, the timing for initiating scanning in the main scanning direction x, indicated by the horizontal synchronizing signal.

Thus, by driving light emission of the light source A1 by the driving unit 14 based on the horizontal synchronizing signal whose timing for initiating scanning has been corrected, it is possible to form a screen line with an aimed screen angle by scanning with the luminous flux whose scanning position deviates in the sub scanning direction y.

Figure 8A:
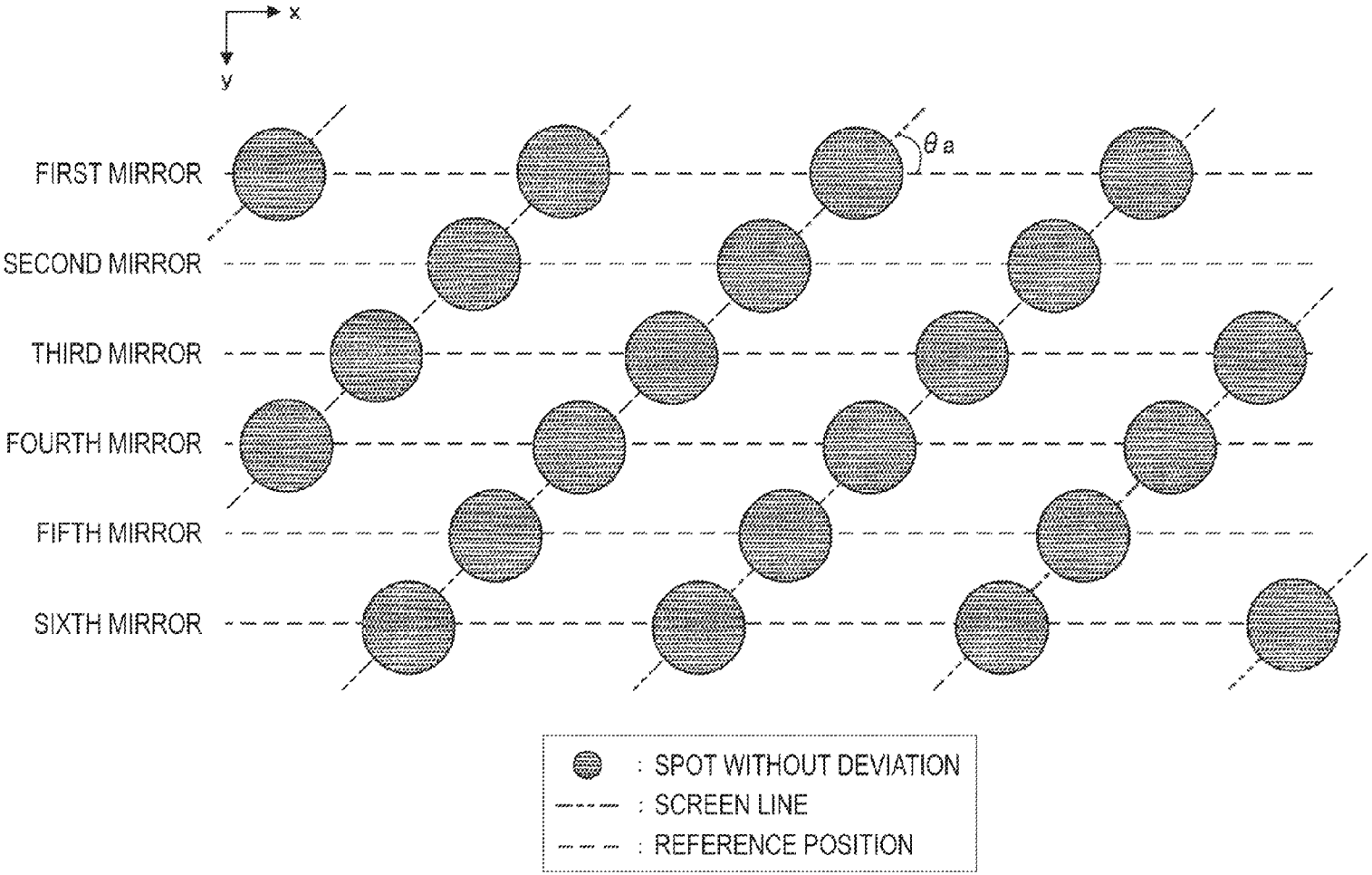
FIG. 8A is a diagram illustrating screen lines in a case where there are no deviations of a scanning position in the main and sub scanning directions.

FIG. 8A illustrates screen lines that have been formed by a luminous flux without deviations of the scanning position in the main scanning direction x and in the sub scanning direction y. Due to the absence of deviations of the scanning position, all spots of the luminous flux which have been scanned by each mirror of the first to sixth mirrors are positioned at the intersections between reference positions and screen lines, and form screen lines with the screen angle θa.

Figure 8B:
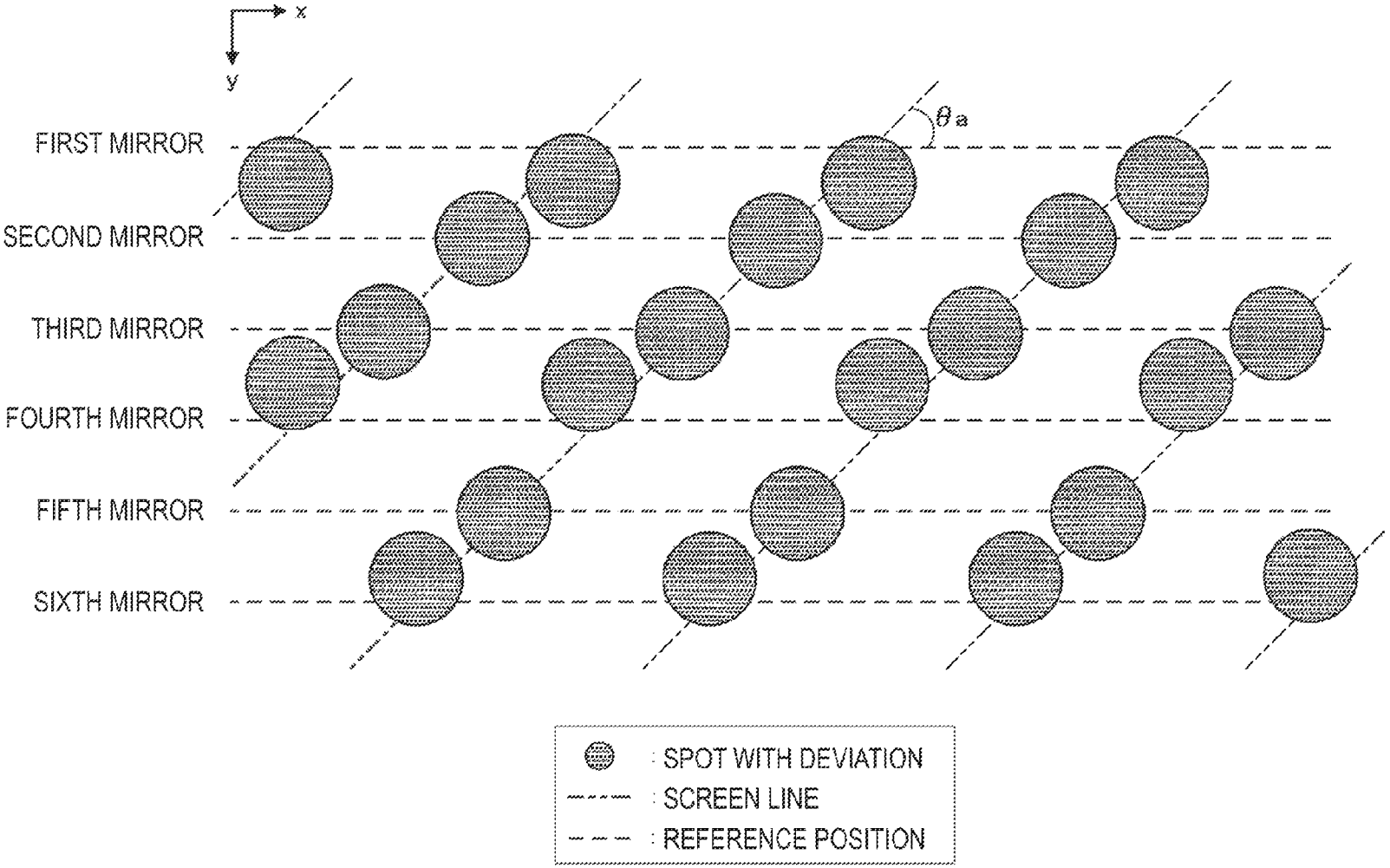
FIG. 8B is a diagram illustrating screen lines in a case where there are deviations of a scanning position in the sub scanning direction.

FIG. 8B illustrates screen lines with deviations of the scanning position in the sub scanning direction y, at the time of scanning with the luminous flux. The spots of the luminous flux that have been scanned by the first, fourth, and sixth mirrors deviate from the positions of the screen lines, and the line shapes thereof are broken by their partial deviations.

The deviation of each mirror repeatedly occurs with the same rotational period as the polygon mirror A4. Therefore, repeated partial deviations of the screen lines become easier to observe as the density fluctuation.

Figure 8C:
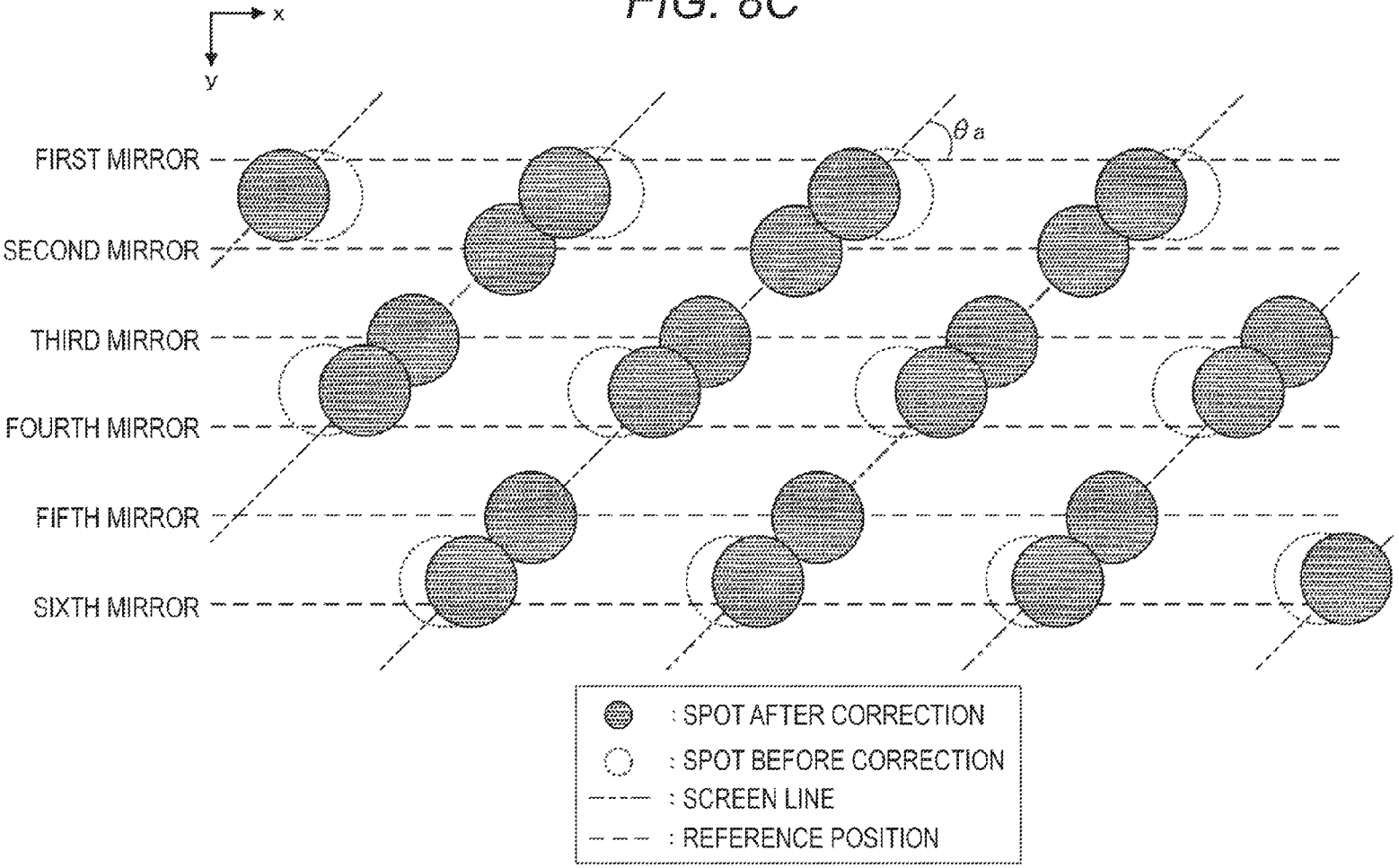
FIG. 8C is a diagram illustrating the screen lines after correction.

FIG. 8C illustrates the screen lines in a case where the scanning positions in the main scanning direction x have been corrected in accordance with the deviation of the scanning position in the sub scanning direction y, illustrated in FIG. 8B.

As illustrated in FIG. 8C, in the first mirror, the scanning position in the sub scanning direction y deviates toward the terminal end. When the deviation amount of the spot from the screen line in the main scanning direction x due to this deviation in the sub scanning direction y is represented as Δxs1, the scanning position in the main scanning direction x can be corrected, as illustrated in FIG. 8C, by advancing the horizontal synchronizing signal by the phase of Δxs1, such that the spot overlaps the screen line with the screen angle θa. On the other hand, in the fourth mirror, the scanning position in the sub scanning direction y deviates toward the starting end. When the deviation amount of the spot from the screen line in the main scanning direction x due to this deviation in the sub scanning direction y is represented as Δxs2, the scanning position in the main scanning direction x can be corrected, as illustrated in FIG. 8C, by delaying the horizontal synchronizing signal by the phase of Δxs2, such that the spot overlaps the screen line with the screen angle θa. By such a correction, the partial deviation of the screen line can be eliminated and the density fluctuation attributable to the deviation can be reduced.

In a case where an image including colors of C, M, Y, and K is formed, the screen angles of the screen lines are typically differentiated in order to prevent moire caused by superimposing images of different colors. The light scanning device 2*a* corresponding to each color corrects, by the corresponding correction unit 13, the scanning position of the luminous flux in the main scanning direction x so as to form a screen line with a screen angle corresponding to each color.

As described above, the image forming device 1 in the present embodiment is an image forming device which scans and exposes the photoreceptor 2*b* with the luminous flux by the light scanning device 2*a*. The light scanning device 2*a* includes the polygon mirror A4, the correction unit 13, and the position deviation detection unit B. The polygon mirror A4*t* deflects the luminous flux, which has been emitted from the light source A1, and scans the photoreceptor 2*b* in the main scanning direction x. The correction unit 13 corrects the scanning position of the luminous flux in the main scanning direction x such that the scanning position of the luminous flux coincides with each reference position in accordance with the pre-detected deviation amount of the scanning position of the luminous flux in the main scanning direction x from each reference position in the main scanning direction x. The position deviation detection unit B detects the deviation amount of the scanning position of the luminous flux in the sub scanning direction y from the reference position in the sub scanning direction y. The correction unit 13 corrects the scanning position of the luminous flux in the main scanning direction x, in a case where a screen line is formed by scanning with the luminous flux, such that the screen line with an aimed screen angle is formed by scanning with the luminous flux whose scanning position in the sub scanning direction y has deviated by the deviation amount that has been detected by the position deviation detection unit B.

As a result, the density fluctuation attributable to the deviation of the scanning position of the luminous flux in the main scanning direction x and in the sub scanning direction y can be reduced. In particular, in a case when a screen line is formed, it is possible to reduce the density fluctuation caused by the partial deviation of the screen line, maintain the line shape of the screen line, and reduce deterioration in the image quality.

The above embodiment is an example of a preferred embodiment of the present invention and is not limited thereto. Appropriate changes can be made without departing from the spirit of the invention.

For example, the deviation of the scanning position in the main scanning direction x has been corrected by outputting the clock signal from the correction unit 13 and adjusting the timing for light emission of the light source A1, but may be corrected by correcting original image data such that the scanning position in the main scanning direction x coincides with the reference position. In this case, it is only necessary that the correction unit 13 correct the position of each pixel in the main scanning direction in accordance with the deviation amount by inputting original image data from the image processing unit 5, and output the image data after correction to the driving unit 14.

Some light scanning devices are of so-called multi-beam type, which can form an image by a plurality of scanning lines by emitting a plurality of luminous fluxes in parallel by a light source with a plurality of light emitting elements and scanning with the luminous fluxes in parallel by a polygon mirror. Even in the multi-beam type light scanning devices, as described above, the correction unit 13 can correct each of the scanning positions of a plurality of luminous fluxes in the main scanning direction x. Some multi-beam type light scanning devices deflect in parallel, without any change, a plurality of luminous fluxes that have been emitted in parallel, while others combine and deflect a plurality of luminous fluxes as one luminous flux, and then separate the one luminous flux and scan the photoreceptor **2*b*** with a plurality of luminous fluxes. In either case, the above mentioned correction method can be applied.

As a computer readable recording medium recording a program for causing the correction unit 13 to execute the above mentioned correction processing, a non-volatile memory such as a ROM and a flash memory, and a portable recording medium such as a CD-ROM can be applied. As a medium for providing program data via communication lines, a carrier wave is also applied.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming device for scanning and exposing a photoreceptor with a luminous flux by a light scanning device, wherein the light scanning device comprises:

a polygon mirror that deflects the luminous flux that has been emitted from a light source and scans the photoreceptor in a main scanning direction;

a correction unit that corrects a scanning position of the luminous flux in the main scanning direction such that the scanning position of the luminous flux coincides with each reference position in accordance with a pre-detected deviation amount of the scanning position of the luminous flux in the main scanning direction from each reference position in the main scanning direction; and a position deviation detection unit that detects the deviation amount of the scanning position of the luminous flux in a sub scanning direction from the reference position in the sub scanning direction, and the correction unit corrects the scanning position of the luminous flux in the main scanning direction, in a case where a screen line is formed by scanning with the luminous flux, such that a screen line with an aimed screen angle is formed by scanning with the luminous flux whose scanning position in the sub scanning direction has deviated by the deviation amount that has been detected by the position deviation detection unit.

2. The image forming device according to claim 1, wherein the position deviation detection unit detects the deviation amount of the scanning position of the luminous flux in the sub scanning direction, using a sensor which detects a luminous flux used to scan near a starting end of each scanning line and generates a horizontal synchronizing signal.

3. The image forming device according to claim 1, wherein the light scanning device emits a plurality of luminous fluxes in parallel by the light source, scans with the luminous fluxes in parallel by the polygon mirror, and corrects the scanning positions of the luminous fluxes in the main scanning direction by the correction unit.

4. The image forming device according to claim 1, comprising a plurality of the light scanning devices corresponding to respective colors, arranged in series, wherein the light scanning devices correct, by respective correction units, the scanning position of the luminous flux in the main scanning direction such that a screen line with a screen angle corresponding to each color is formed.

5. A method for correcting a scanning position of a luminous flux used for scanning in a main scanning direction by deflecting a luminous flux that has been emitted from a light source by a polygon mirror, the method comprising:

(a) a step of correcting the scanning position of the luminous flux in the main scanning direction in accordance with a pre-detected deviation amount of the scanning position of the luminous flux in the main scanning direction from each reference position in the main scanning direction, such that the scanning position of the luminous flux coincides with each reference position;

(b) a step of detecting the deviation amount of the scanning position of the luminous flux in a sub scanning direction from the reference position in the sub scanning direction; and (c) a step of correcting the scanning position of the luminous flux in the main scanning direction such that a screen line with an aimed screen angle is formed by scanning with the luminous flux whose scanning position in the sub scanning direction has deviated by the deviation amount that has been detected in the step (b).

* * * * *